US009091991B2

(12) United States Patent
Yamada

(10) Patent No.: US 9,091,991 B2
(45) Date of Patent: Jul. 28, 2015

(54) STRIPPING MECHANISM, IMAGE-FORMING UNIT, AND IMAGE-FORMING APPARATUS

(71) Applicant: FUJI XEROX CO., LTD., Tokyo (JP)

(72) Inventor: Wataru Yamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/197,319

(22) Filed: Mar. 5, 2014

(65) Prior Publication Data

US 2015/0071693 A1 Mar. 12, 2015

(30) Foreign Application Priority Data

Sep. 9, 2013 (JP) ..... 2013-186746

(51) Int. Cl.
*G03G 15/14* (2006.01)
*G03G 15/00* (2006.01)

(52) U.S. Cl.
CPC ..... *G03G 15/6532* (2013.01)

(58) Field of Classification Search
CPC ..... G03G 15/6532
USPC ..... 399/399
See application file for complete search history.

(56) References Cited

U.S. PATENT DOCUMENTS

| | | | | |
|---|---|---|---|---|
| 4,511,238 | A * | 4/1985 | Hori | 399/206 |
| 4,806,985 | A * | 2/1989 | Foley et al. | 399/399 |
| 5,970,305 | A * | 10/1999 | Shin | 399/398 |
| 6,293,545 | B1 * | 9/2001 | Hanks et al. | 271/311 |
| 6,769,686 | B1 * | 8/2004 | Yuge | 271/307 |
| 8,313,190 | B2 * | 11/2012 | Castillo et al. | 347/104 |
| 8,380,118 | B2 * | 2/2013 | Barton | 399/398 |
| 8,892,024 | B2 * | 11/2014 | Deguchi et al. | 399/398 |
| 2008/0213010 | A1 * | 9/2008 | Oyama et al. | 399/313 |
| 2013/0148988 | A1 * | 6/2013 | Murakami | 399/21 |

FOREIGN PATENT DOCUMENTS

| | | |
|---|---|---|
| JP | A-2002-023506 | 1/2002 |
| JP | A-2002-139918 | 5/2002 |
| JP | A-2003-122174 | 4/2003 |

* cited by examiner

*Primary Examiner* — Anthony Nguyen
(74) *Attorney, Agent, or Firm* — Oliff PLC

(57) ABSTRACT

A stripping mechanism includes a substantially sheet-shaped stripping member that has a first surface and a second surface opposite the first surface, that is elastically deformed with part of the first surface in contact with an image carrier which rotates and carries an image, and that strips a recording medium from the image carrier; and an opposing member that is disposed downstream of the stripping member in a direction in which the image carrier moves, that extends toward the image carrier, and that is opposite the first surface of the stripping member.

5 Claims, 7 Drawing Sheets

STRIPPING MECHANISM, IMAGE-FORMING UNIT, AND IMAGE-FORMING APPARATUS

CROSS-REFERENCE TO RELATED APPLICATIONS

This application is based on and claims priority under 35 USC 119 from Japanese Patent Application No. 2013-186746 filed Sep. 9, 2013.

BACKGROUND (i) Technical Field

The present invention relates to stripping mechanisms, image-forming units, and image-forming apparatuses.

(ii) Related Art

There are image-forming apparatuses in the related art that include a separating claw as a separating mechanism that separates transfer paper from a photoreceptor.

SUMMARY

According to an aspect of the invention, there is provided a stripping mechanism including a substantially sheet-shaped stripping member that has a first surface and a second surface opposite the first surface, that is elastically deformed with part of the first surface in contact with an image carrier which rotates and carries an image, and that strips a recording medium from the image carrier; and an opposing member that is disposed downstream of the stripping member in a direction in which the image carrier moves, that extends toward the image carrier, and that is opposite the first surface of the stripping member.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the attached drawings.

Figure 1:
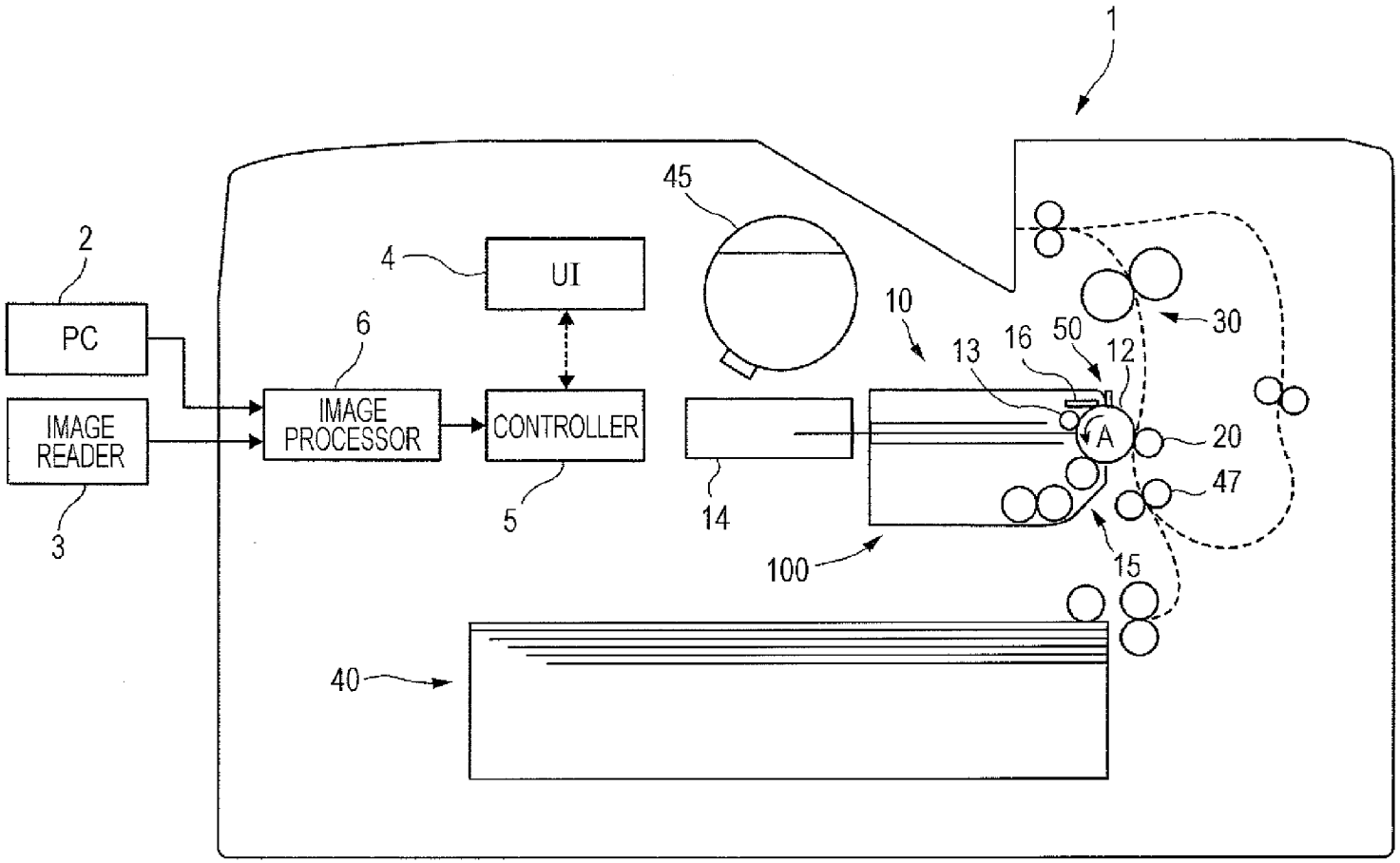
FIG. 1 illustrates an example configuration of an image-forming apparatus according to an exemplary embodiment.

FIG. 1 illustrates an example configuration of an image-forming apparatus 1 according to an exemplary embodiment. The illustrated image-forming apparatus 1 is a monochrome printer including an image-forming section 10 that forms an image corresponding to image data; a user interface (UI) 4 that accepts an instruction from the user and that displays, for example, a message for the user; a controller 5 that controls the operation of the entire image-forming apparatus 1; and an image processor 6 that is connected to external devices such as a personal computer (PC) 2 and an image reader 3 and that processes image data received therefrom.

The image-forming apparatus 1 further includes a recording medium feeder 40 that feeds recording media to the image-forming section 10 and a toner cartridge 45 that supplies toner to the image-forming section 10.

Figure 2:
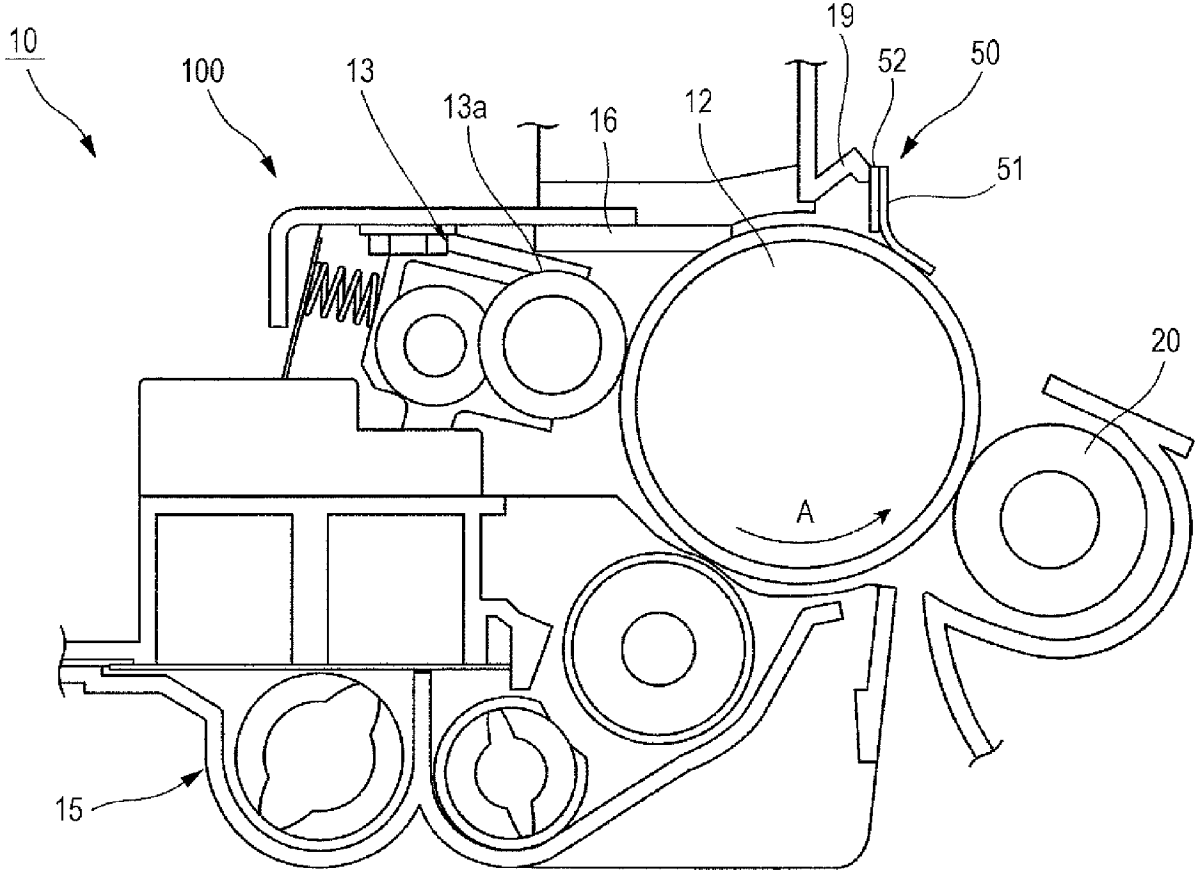
FIG. 2 illustrates an example configuration of an image-forming section according to the exemplary embodiment.

FIG. 2 illustrates an example configuration of the image-forming section 10 according to this exemplary embodiment.

As shown in FIG. 2, the image-forming section 10 includes a photoreceptor drum 12, which is an example of an image carrier, that is configured to be rotatable, that allows an electrostatic latent image to be formed thereon, and that carries a toner image; a charging device 13 that charges the surface of the photoreceptor drum 12; an exposure device 14 (see FIG. 1) that exposes the surface of the photoreceptor drum 12 charged by the charging device 13 based on image data; a developing device 15 that develops an electrostatic latent image formed on the photoreceptor drum 12; and a cleaner 16 that cleans the surface of the photoreceptor drum 12 after transfer. The photoreceptor drum 12 in this exemplary embodiment includes a rotating shaft (not shown) having an axis oriented in the direction from the front (out of the page) to the rear (into the page) of the image-forming apparatus 1.

The image-forming section 10 further includes a transfer roller 20, which is an example of a transfer unit, that forms a transfer nip with the photoreceptor drum 12 and that transfers a toner image from the photoreceptor drum 12 to a recording medium; and a fixing device 30 (see FIG. 1) that fixes the toner image to the recording medium.

The image-forming section 10 further includes a stripping device 50, which is an example of a stripping mechanism, that strips the recording medium to which the toner image is transferred by the transfer roller 20 from the surface of the photoreceptor drum 12.

In the image-forming section 10 according to this exemplary embodiment, the photoreceptor drum 12, the charging device 13, the developing device 15, the cleaner 16, and the stripping device 50 are integrated into an image-forming module 100. The image-forming module 100 is attachable to and detachable from the image-forming apparatus 1 (see FIG. 1) and is replaceable, for example, at the end of the life of the photoreceptor drum 12.

The stripping device 50 is detachable from a housing 19 of the image-forming module 100 and is replaceable after deterioration of the stripping device 50. The stripping device 50 is also attachable to an image-forming module 100 or image-forming apparatus 1 including no stripping device 50.

The charging device 13 in this exemplary embodiment employs contact charging; it includes a charging roller 13*a* in contact with the surface of the photoreceptor drum 12 and applies a voltage to the charging roller 13*a* to charge the surface of the photoreceptor drum 12.

Typical methods for applying a voltage to a charging member for charging the photoreceptor drum 12 include direct-current charging, in which only a direct-current voltage is applied, and superimposed alternating-current charging, in which a direct-current voltage is applied with an alternating-current voltage superimposed thereon. This exemplary embodiment employs direct-current charging, in which only a direct-current voltage is applied to the charging roller 13*a*.

The developing device 15 in this exemplary embodiment develops an electrostatic latent image on the photoreceptor drum 12 with a polymerized toner.

As used herein, the term "polymerized toner" generally refers to toners manufactured in a liquid, including toners manufactured by mixing colorant particles and monomers and then polymerizing the mixture, and toners manufactured by emulsifying a prepolymerized resin and colorant particles in water and then coalescing the particles; they are distinguished from pulverized toners, which are manufactured by pulverizing raw materials. In general, polymerized toners are more uniform in particle diameter and closer in shape to a sphere than pulverized toners. The developing device 15 in this exemplary embodiment may use a toner having an average particle diameter (D50) of, for example, 2 to 12 μm, preferably 3 to 9 μm. The use of a toner having an average shape factor ($ML^2/A$) of 115 to 140 provides high developability and transferability and thus provides a high-quality image. ML is the absolute maximum length of the toner particles, and A is the projected area of the toner particles.

The cleaner 16 in this exemplary embodiment is, for example, a blade that is pressed against the surface of the photoreceptor drum 12 to scrape off residual toner deposited on the surface of the photoreceptor drum 12 after transfer from the surface of the photoreceptor drum 12.

In this image-forming apparatus 1, the image-forming section 10 performs an image formation process based on various control signals fed from the controller 5. Specifically, under the control of the controller 5, image data input from the PC 2 or the image reader 3 is processed by the image processor 6 and is fed to the image-forming section 10. In the image-forming section 10, while the photoreceptor drum 12 is rotated in the direction indicated by arrow A, it is charged to a predetermined potential by the charging device 13 and is exposed to light by the exposure device 14 based on the image data received from the image processor 6. In this manner, an electrostatic latent image corresponding to the image data is formed on the photoreceptor drum 12. The electrostatic latent image formed on the photoreceptor drum 12 is developed, for example, as a black (K) toner image by the developing device 15 to form a toner image corresponding to the image data on the photoreceptor drum 12.

The toner image formed on the photoreceptor drum 12 is electrostatically transferred to a recording medium transported to the transfer nip by the transfer roller 20.

Thereafter, the recording medium to which the toner image is transferred is stripped from the surface of the photoreceptor drum 12 by the stripping device 50 and is transported to the fixing device 30. The toner image on the recording medium transported to the fixing device 30 is fixed to the recording medium with heat and pressure by the fixing device 30. The recording medium on which a fixed image is formed is transported to a paper output stacker (not shown) disposed in a paper output section of the image-forming apparatus 1.

The toner (residual toner) deposited on the surface of the photoreceptor drum 12 after transfer is removed from the surface of the photoreceptor drum 12 by the cleaner 16 after transfer is complete.

In this manner, the image formation process is repeated for the number of cycles corresponding to the number of prints.

Next, the configuration of the photoreceptor drum 12 in this exemplary embodiment will be described. Commonly used photoreceptor drums include inorganic photoreceptors and organic photoreceptors, of which organic photoreceptors are currently frequently used for several reasons, including cost, manufacturability, and performance. Organic photoreceptors include single-layer organic photoreceptors and multilayer organic photoreceptors; the former is frequently used for positive charging, whereas the latter is frequently used for negative charging. The following description will focused on multilayer photoreceptor drums.

Figure 3A:
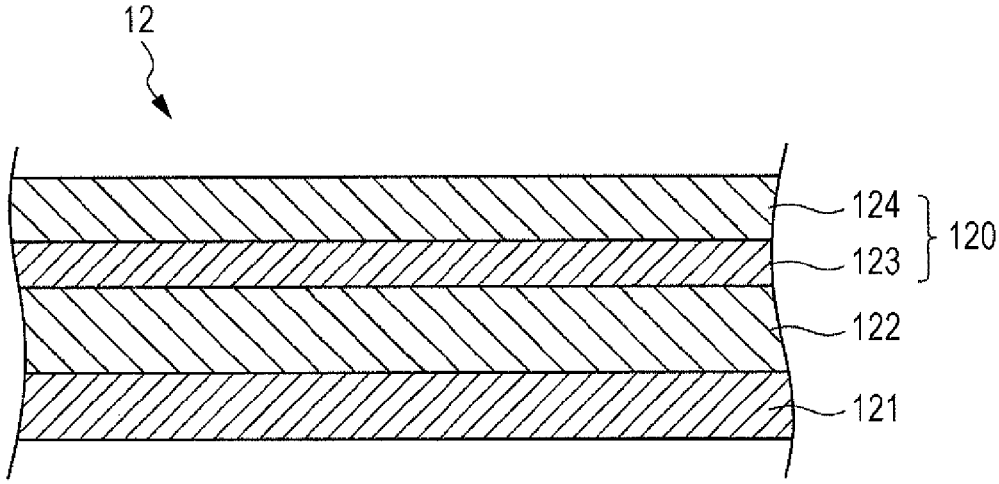
FIGS. 3A and 3B illustrate layer configurations of a photoreceptor drum according to the exemplary embodiment.
Figure 3B:
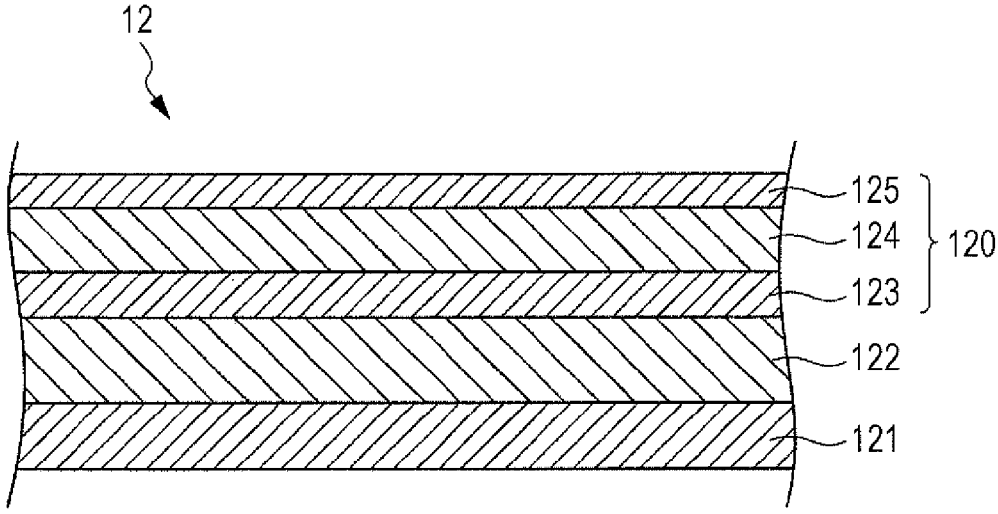

FIGS. 3A and 3B illustrate examples of layer configurations of the photoreceptor drum 12 according to this exemplary embodiment.

As shown in FIG. 3A, the photoreceptor drum 12 in this exemplary embodiment is a function-separated photoreceptor (multilayer photoreceptor) and includes a conductive substrate 121, an undercoat layer 122 formed on the conductive substrate 121, a charge generation layer 123 formed on the undercoat layer 122, and a charge transport layer 124, which is an example of a fluorine-containing layer, formed on the charge generation layer 123. In this example, the charge generation layer 123 and the charge transport layer 124 form a photosensitive layer 120.

The conductive substrate 121 is made of a conductive material. The material for the conductive substrate 121 may be any conductive material, for example, a metal such as an aluminum alloy. The term"conductive" refers to, for example, a volume resistivity of $10^{13}$ Ω·cm or less. The conductive substrate 121 is grounded when the image-forming module 100 (see FIG. 2) is attached to the image-forming apparatus 1 (see FIG. 1). The conductive substrate 121 is not necessarily drum-shaped, but may be, for example, belt- or sheet-shaped.

The undercoat layer 122 is provided to block injection of charge from the conductive substrate 121 into the multilayer photosensitive layer 120 during the charging of the photosensitive layer 120 and to integrally secure the photosensitive layer 120 to the conductive substrate 121.

The undercoat layer 122 contains, for example, a binder resin and conductive particles.

Examples of binder resins contained in the undercoat layer 122 include known polymer resins such as acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, urethane resins, and epoxy resins; charge transport resins having a charge transport group; and conductive resins such as polyaniline. In particular, resins insoluble in the coating solvents for the upper layers are preferred, and resins such as phenolic resins, phenol-formaldehyde resins, melamine resins, urethane resins, and epoxy resins are more preferred.

Examples of conductive particles contained in the undercoat layer 122 include metal particles such as aluminum, copper, nickel, and silver; conductive metal oxide particles such as antimony oxide, indium oxide, tin oxide, and zinc oxide; and conductive material particles such as carbon fiber, carbon black, and graphite powder. In particular, conductive metal oxide particles are preferred. These conductive particles may be used alone or as a mixture of two or more.

The surface of the conductive particles may be treated, for example, with a hydrophobing agent (such as a coupling agent) for resistance control.

For example, the conductive particles are preferably present in an amount of 10% to 80% by mass, more preferably 40% to 80% by mass, based on the amount of binder resin.

The undercoat layer 122 may contain an electron transport agent for improved electrical properties. Examples of electron transport agents added to the undercoat layer 122 include electron transport compounds such as quinones such as p-benzoquinone, chloranil, bromanil, and anthraquinone; tetracyanoquinodimethanes; fluorenones such as 2,4,7-trinitrofluorenone; xanthones; benzophenones; cyanovinyl compounds; and ethylenes.

The charge generation layer 123 generates carrier pairs of electrons and holes upon irradiation with light by the exposure device 14 (see FIG. 1) described above.

The charge generation layer 123 contains, for example, a charge generation material and a binder resin.

Examples of charge generation materials include phthalocyanine pigments such as metal-free phthalocyanine, chlorogallium phthalocyanine, hydroxygallium phthalocyanine, dichlorotin phthalocyanine, and titanyl phthalocyanine. Other examples include azo pigments, quinone pigments, perylene pigments, indigo pigments, bisbenzimidazole pigments, anthrone pigments, and quinacridone pigments. These charge generation materials may be used alone or as a mixture of two or more.

Examples of binder resins contained in the charge generation layer 123 include polycarbonate resins, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride copolymer resins, silicone resins, phenol-formaldehyde resins, polyacrylamide resins, polyamide resins, and poly-N-vinylcarbazole resins. These binder resins may be used alone or as a mixture of two or more.

The mixing ratio of the charge generation material to the binder resin may be, for example, 10:1 to 1:10.

The charge transport layer 124 transports the carriers generated by the charge generation layer 123 upon irradiation with light by the exposure device 14.

The charge transport layer 124 contains, for example, a charge transport material and a binder resin.

Examples of charge transport materials include, but not limited to, hole transport compounds such as triarylamines, benzidines, arylalkanes, aryl-substituted ethylenes, stilbenes, anthracenes, and hydrazones. These charge transport materials may be used alone or as a mixture of two or more.

Examples of binder resins contained in the charge transport layer 124 include polycarbonate resins, polyester resins, methacrylic resins, acrylic resins, polyvinyl chloride resins, polyvinylidene chloride resins, polystyrene resins, polyvinyl acetate resins, styrene-butadiene copolymer resins, vinylidene chloride-acrylonitrile copolymer resins, vinyl chloride-vinyl acetate copolymer resins, vinyl chloride-vinyl acetate-maleic anhydride copolymer resins, silicone resins, silicone-alkyd resins, phenol-formaldehyde resins, and styrene-alkyd resins. These binder resins may be used alone or as a mixture of two or more.

The mixing ratio of the charge transport material to the binder resin may be, for example, 10:1 to 1:5.

If the charge transport layer 124 is used as the outermost layer of the photoreceptor drum 12, it may contain a fluorinated compound (fluorinated material) for improved wear resistance, reduced friction, and improved cleanability.

Examples of fluorinated compounds include polytetrafluoroethylene (PTFE), tetrafluoroethylene-hexafluoropropylene copolymer (FEP), tetrafluoroethylene-perfluoro(alkyl vinyl ether) copolymer (PFA), ethylene-tetrafluoroethylene copolymer (ETFE), ethylene-chlorotrifluoroethylene copolymer (ECTFE), and resins prepared by copolymerization of fluorocarbon resins with monomers having a hydroxyl group. In particular, PTFE, FEP, and PFA are preferred in terms of electrical properties.

As shown in FIG. 3B, the photoreceptor drum 12 may further include a protective layer 125 on the charge transport layer 124 to improve the wear resistance of the outer surface of the photoreceptor drum 12 and to reduce a chemical change in the charge generation layer 123 and the charge transport layer 124 during the charging of the photoreceptor drum 12.

The protective layer 125 may be similar to the charge transport layer 124 described above. In addition to the binder resins described above, curable resins may be used. In this exemplary embodiment, the protective layer 125 may contain a fluorinated compound. The fluorinated compound contained in the protective layer 125 may be similar to those illustrated for the charge transport layer 124 described above.

Figure 4:
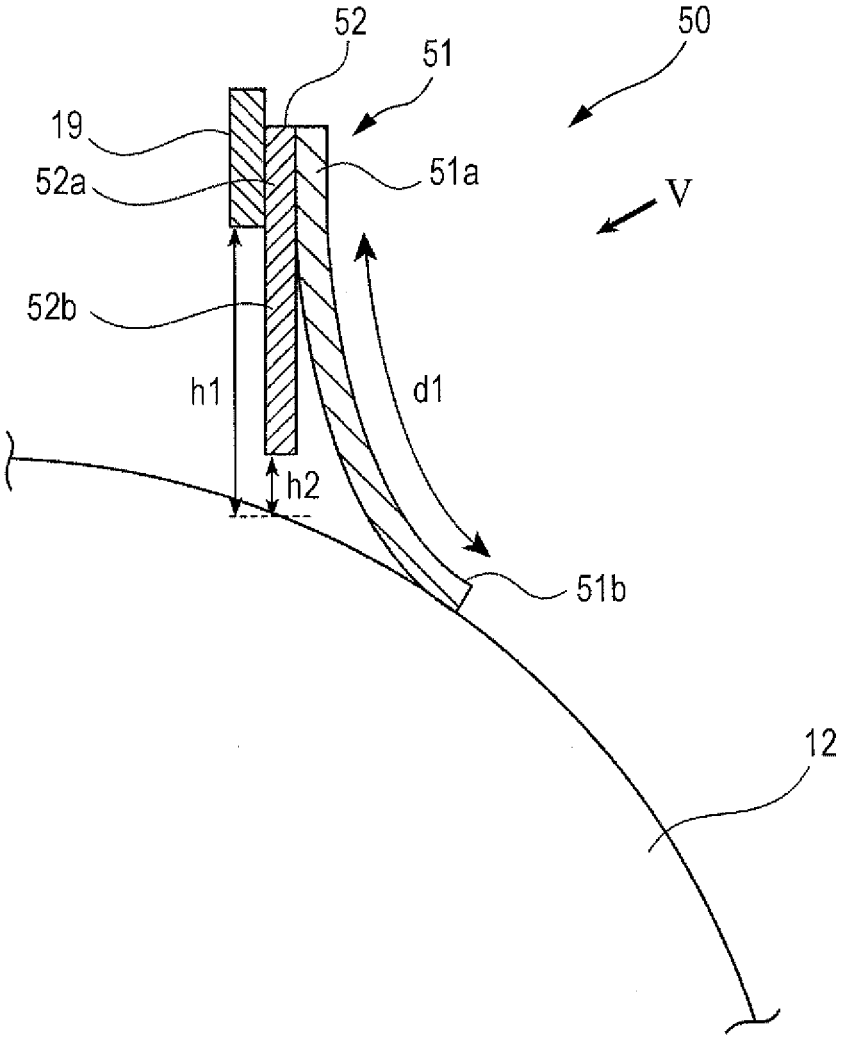
FIG. 4 illustrates the configuration of a stripping device according to the exemplary embodiment.
Figure 5:
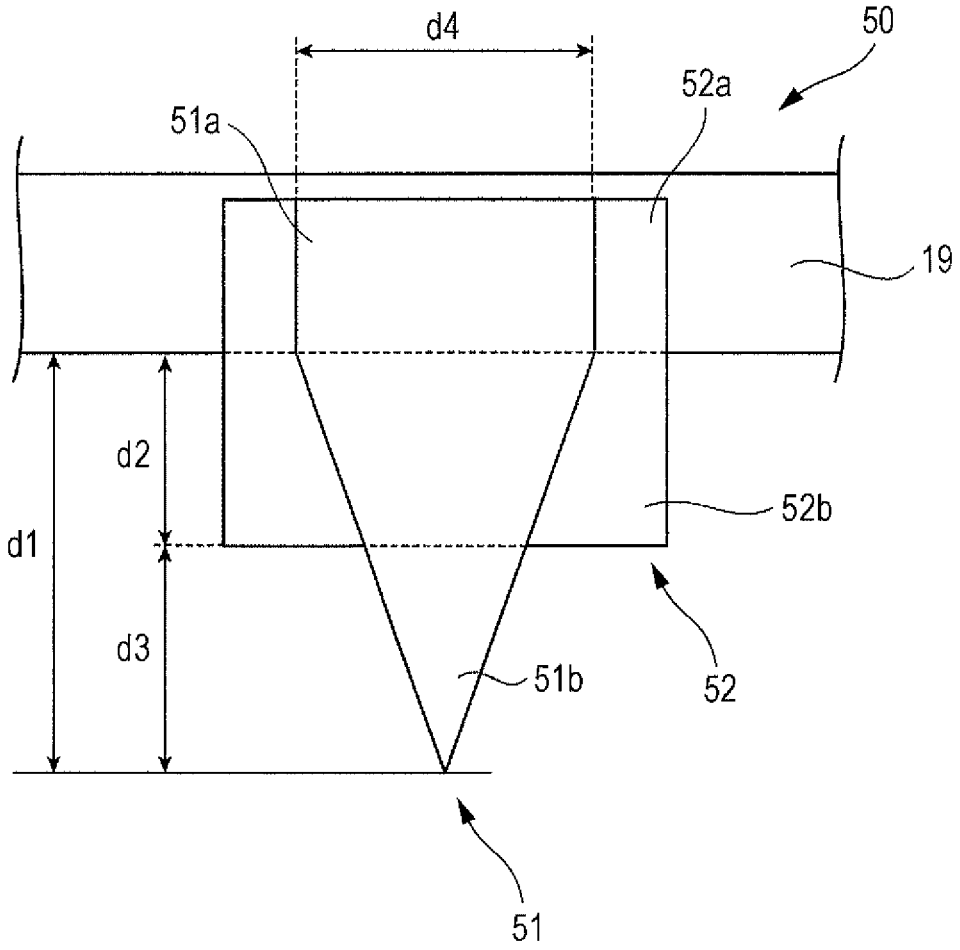
FIG. 5 is a front view of the stripping device as viewed from arrow V in FIG. 4.

Next, the configuration of the stripping device 50 according to this exemplary embodiment will be described. FIG. 4 illustrates the configuration of the stripping device 50 according to this exemplary embodiment. FIG. 5 is a front view of the stripping device 50 as viewed from arrow V in FIG. 4.

As shown in FIG. 4, the stripping device 50 according to this exemplary embodiment includes a stripping film 51, which is an example of a stripping member, and an assisting member 52 to which the stripping film 51 is attached and that assists the stripping film 51 in stripping recording media. In this exemplary embodiment, the assisting member 52 serves as an opposing member or pressing member.

The stripping device 50 is attached to the housing 19 of the image-forming module 100 so as to be detachable from the housing 19.

The stripping film 51 in this exemplary embodiment is a flexible thin film.

The stripping film 51 may be made of, for example, polyethylene terephthalate (PET), polycarbonate (PC), polyamideimide, polyimide, or polyarylate, preferably PET or PC.

The stripping film 51 preferably has a thickness of, for example, 0.05 to 0.5 mm, more preferably 0.075 to 0.2 mm. A stripping film 51 having such a thickness may smoothly strip recording media without damaging the photoreceptor drum 12.

As shown in FIG. 5, the stripping film 51 in this exemplary embodiment includes a mounting portion 51*a* having one surface (first surface) thereof attached to the assisting member 52 and a stripping portion 51*b*, which is an example of a separated portion, that extends from the mounting portion 51*a* toward the photoreceptor drum 12 and that strips recording media.

The mounting portion 51*a* of the stripping film 51 in this exemplary embodiment is attached to the assisting member 52, for example, using a double-sided tape or adhesive.

As shown in FIG. 5, the stripping portion 51*b* of the stripping film 51 in this exemplary embodiment has the shape of an isosceles triangle. Specifically, the stripping portion 51*b* has the shape of an isosceles triangle whose base is adjacent to the mounting portion 51*a* and whose vertex is in contact with the photoreceptor drum 12 (see FIG. 4).

The assisting member 52 in this exemplary embodiment may be, but not necessarily, a sheet- or block-shaped member or a member integrally formed with the housing 19, or the housing 19 itself may be configured to function as the assisting member 52. The assisting member 52 may be made of, for example, a metal such as stainless steel or aluminum, or a resin. For example, the assisting member 52 may be a thin film similar to the stripping film 51.

As shown in FIG. 5, the assisting member 52 in this exemplary embodiment includes a mounting portion 52*a* to which the mounting portion 51*a* of the stripping film 51 is attached and an assisting portion 52*b* that extends from the mounting portion 52*a* toward the photoreceptor drum 12, that is opposite the stripping portion 51*b* of the stripping film 51, and that assists the stripping film 51 in stripping recording media.

The stripping device 50 is attached to the image-forming module 100, for example, by bonding the back surface (the surface facing away from the stripping film 51) of the mounting portion 52*a* of the assisting member 52 to the housing 19.

As shown in FIG. 4, in the state where the stripping device 50 in this exemplary embodiment is attached to the housing 19, the assisting member 52 is located downstream of the stripping film 51 in the transport direction of recording media (downstream of the stripping film 51 in the direction in which the photoreceptor drum 12 moves).

As shown in FIG. 4, in the state where the stripping device 50 in this exemplary embodiment is attached to the housing 19, the distance from the photoreceptor drum 12 to the upper end of the assisting portion 52*b* of the assisting member 52 is h1, and the distance from the photoreceptor drum 12 to the lower end of the assisting portion 52*b* of the assisting member 52 is h2 (<h1).

As shown in FIG. 5, the assisting member 52 in this exemplary embodiment is rectangular in a front view. Although the assisting member 52 in this example is wider than the stripping film 51 in the axial direction of the photoreceptor drum 12, the assisting member 52 may be formed in other shapes.

As shown in FIG. 5, the length of the stripping portion 51*b* of the stripping film 51 from the side of the stripping portion 51*b* adjacent to the mounting portion 51*a* to the leading end of the stripping portion 51*b* in contact with the photoreceptor drum 12 is d1. The length of the assisting portion 52*b* of the assisting member 52 from the side of the assisting portion 52*b* adjacent to the housing 19 to the side of the assisting portion 52*b* facing the photoreceptor drum 12 is d2. The length d1 of the stripping film 51 (stripping portion 51*b*) is larger than the length d2 of the assisting member 52 (assisting portion 52*b*) (d1>d2). Thus, the stripping portion 51*b* of the stripping film 51 extends at the leading end thereof beyond the assisting member 52 toward the photoreceptor drum 12.

The length d1 of the stripping film 51 is also larger than the distance from the mounting portion 52*a* of the assisting member 52 to the surface of the photoreceptor drum 12. As a result, as shown in FIG. 4, one surface of the stripping portion 51*b* of the stripping film 51 is in contact at the leading end thereof with the photoreceptor drum 12. The stripping portion 51*b* of the stripping film 51 is elastically deformed into a bent shape.

In this exemplary embodiment, the width of the mounting portion 51*a* of the stripping film 51 in the axial direction of the photoreceptor drum 12 is d4.

The stripping film 51 is not necessarily formed in the shape illustrated in FIG. 5. For example, the stripping film 51 may be trapezoidal or rectangular, or the perimeter thereof may be curved.

As in the example illustrated in FIG. 5, the stripping portion 51*b* of the stripping film 51 may be tapered, i.e., narrower in the axial direction of the photoreceptor drum 12 from the side of the stripping portion 51*b* adjacent to the mounting portion 51*a* toward the leading end of the stripping portion 51*b* in contact with the photoreceptor drum 12.

Because the stripping film 51 is tapered, the stripping portion 51*b* may bend more easily at the leading end thereof. Accordingly, the stripping portion 51*b* may conform more closely to the surface of the photoreceptor drum 12 and may therefore come into closer contact with the photoreceptor drum 12. This may prevent, for example, entry of recording media between the stripping film 51 and the surface of the photoreceptor drum 12, thus preventing a media jam.

In the image-forming section 10 (see FIG. 1) including the stripping device 50 described above, a recording medium is transported while being wound around the surface of the photoreceptor drum 12, and toner is transferred to the recording medium by the transfer roller 20 (see FIG. 2). Thereafter, the stripping portion 51*b* of the stripping film 51 of the stripping device 50 enters at the leading end thereof between the recording medium wound around the surface of the photoreceptor drum 12 and the surface of the photoreceptor drum 12. As the photoreceptor drum 12 rotates, the recording medium is advanced over the stripping film 51. In other words, as the photoreceptor drum 12 rotates, the stripping film 51 is advanced between the recording medium and the surface of the photoreceptor drum 12 while stripping the recording medium from the surface of the photoreceptor drum 12.

As a result, the recording medium is moved away from the photoreceptor drum 12 downstream in the transport direction. In this manner, the recording medium may be stripped from the surface of the photoreceptor drum 12.

The state of the stripping film 51 according to this exemplary embodiment when no recording medium is transported to the stripping device 50 differs from the state of the stripping film 51 when a recording medium is transported to and stripped by the stripping device 50.

The state of the stripping film 51 when no recording medium is transported to the stripping device 50 will be described first with reference to FIG. 4 described above.

As shown in FIG. 4, when no recording medium is transported to the stripping device 50, the leading end of the stripping portion 51*b* of the stripping film 51 is in contact with the surface of the photoreceptor drum 12. The leading end of the stripping portion 51*b* is pressed against the surface of the photoreceptor drum 12 such that the stripping film 51 is elastically deformed into a curved shape. As a result, as shown in FIG. 4, the stripping portion 51*b* of the stripping film 51 is separated from the assisting portion 52*b* of the assisting member 52. In other words, in the state shown in FIG. 4, the leading portion of the stripping film 51 corresponding to the length d1 is separated from the assisting member 52 in the region closer to the photoreceptor drum 12 than the position at the distance h1 from the photoreceptor drum 12.

In the state shown in FIG. 4, the stripping film 51 in this exemplary embodiment is in contact with the surface of the photoreceptor drum 12 under a predetermined contact force a1.

The contact force of the stripping film 51 on the photoreceptor drum 12 varies depending on the properties, including thickness, length, and material, of the stripping film 51. In this exemplary embodiment, the term "contact force of the stripping film 51 on the photoreceptor drum 12" refers to the force with which the stripping film 51 presses the surface of the photoreceptor drum 12 at the position where the stripping film 51 is in contact with the surface of the photoreceptor drum 12.

The state of the stripping device 50 when a recording medium is transported to and stripped by the stripping device 50 will then be described.

Figure 6:
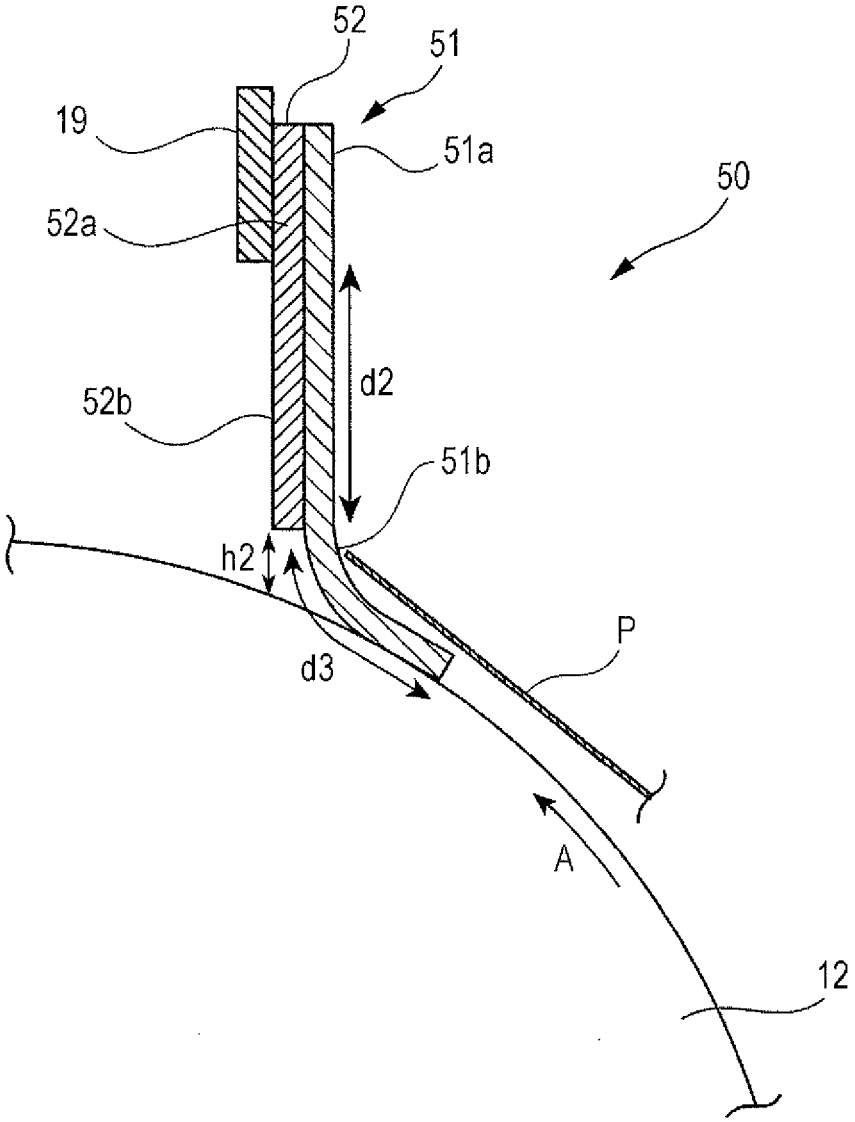
FIG. 6 illustrates the state when a recording medium is transported to the stripping device according to the exemplary embodiment.

FIG. 6 illustrates the state when a recording medium is transported to the stripping device 50 according to this exemplary embodiment.

As shown in FIG. 6, when a recording medium P to which an image is transferred by the transfer roller 20 (see FIG. 2) is transported to the stripping device 50, the recording medium P being transferred presses the stripping portion 51*b* of the stripping film 51 downstream in the transport direction (downstream in the rotational direction of the photoreceptor drum 12).

Accordingly, the stripping portion 51*b* of the stripping film 51, which is initially separated from the assisting member 52, is, moved toward the assisting member 52. As a result, the upper region (the region closer to the mounting portion 51*a*) of the stripping portion 51*b* comes into contact with the assisting portion 52*b* of the assisting member 52.

As described above, the length d1 of the stripping film 51 is larger than the length d2 of the assisting member 52; therefore, the stripping portion 51*b* of the stripping film 51 extends at the leading end thereof beyond the assisting member 52 toward the photoreceptor drum 12 without contact with the assisting member 52. In other words, in the state shown in FIG. 6, only the leading portion of the stripping film 51 corresponding to a length d3 (=d1−d2) is separated from the assisting member 52 in the region closer to the photoreceptor drum 12 than the position at the distance h2 from the photoreceptor drum 12.

In the state shown in FIG. 6, the stripping film 51 in this exemplary embodiment is in contact with the surface of the photoreceptor drum 12 under a predetermined contact force a2.

If the flexible stripping film 51 is used, as in the stripping device 50 according to this exemplary embodiment, the contact force of the stripping film 51 on the photoreceptor drum 12 varies depending on the manner in which the stripping film 51 is supported relative to the photoreceptor drum 12 for the same properties, including thickness and material, of the stripping film 51.

Accordingly, the contact force a2 of the stripping film 51 on the photoreceptor drum 12 in the state shown in FIG. 6 when a recording medium is transported to the stripping device 50 differs from the contact force a1 in the state shown in FIG. 4 when no recording medium is transported to the stripping device 50.

Specifically, as shown in FIG. 6, when a recording medium is transported to the stripping device 50, the stripping film 51 is supported at a position closer to the photoreceptor drum 12 than in the state shown in FIG. 4, and the stripping film 51 (stripping portion 51*b*) is largely elastically deformed. That is, in the state shown in FIG. 6, the stripping film 51 is elastically deformed into a curved shape with a larger curvature than in the state shown in FIG. 4.

In the state shown in FIG. 6, the portion of the stripping film 51 (stripping portion 51*b*) not in contact with the assisting member 52 is shorter than in the state shown in FIG. 4.

In the state shown in FIG. 6, the stripping film 51 (stripping portion 51*b*) is in contact with the photoreceptor drum 12 at a position closer to the assisting member 52 than in the state shown in FIG. 4.

Accordingly, the contact force a2 of the stripping film 51 on the photoreceptor drum 12 in the state shown in FIG. 6 when a recording medium is transported to the stripping device 50 is larger than the contact force a1 in the state shown in FIG. 4 when no recording medium is transported to the stripping device 50 (a2>a1).

Because the stripping device 50 according to this exemplary embodiment is configured as described above, the contact force of the stripping film 51 on the photoreceptor drum 12 may become larger when a recording medium is transported to the stripping device 50. That is, the contact force of the stripping film 51 on the photoreceptor drum 12 may be temporarily increased during the stripping of recording media by the stripping device 50 according to this exemplary embodiment.

As a result, the stripping device 50 may prevent entry of recording media between the stripping film 51 and the surface of the photoreceptor drum 12 during the stripping of the recording medium, thus preventing a media jam.

In general, a thinner or less rigid stripping film 51 places a lower load on the surface of the photoreceptor drum 12 and thus causes less damage to the surface of the photoreceptor drum 12, although such a stripping film 51 tends to cause problems with stripping, such as a media jam.

In this exemplary embodiment, as described above, because the contact force of the stripping film 51 on the photoreceptor drum 12 may be temporarily increased during the stripping of recording media, they may be smoothly stripped, for example, with a stripping film 51 thinner or less rigid than those in the related art.

In this exemplary embodiment, the contact force of the stripping film 51 on the photoreceptor drum 12 becomes smaller when no recording medium is transported to the stripping device 50.

As a result, in this exemplary embodiment, the stripping film 51 may place a lower load on the photoreceptor drum 12 and may thus cause less damage to the surface of the photoreceptor drum 12 than without the configuration according to this exemplary embodiment.

Because the stripping film 51 may place a lower load on the photoreceptor drum 12, the photoreceptor drum 12 and the image-forming module 100 including the photoreceptor drum 12 may have a longer life than without the configuration according to this exemplary embodiment.

Because the assisting member 52 is provided in the stripping device 50 according to this exemplary embodiment, a narrower space is formed between the surface of the photoreceptor drum 12 and the stripping device 50 than without the configuration according to this exemplary embodiment. As a result, for example, when a recording medium is transported to the stripping device 50 according to this exemplary embodiment, the stripping device 50 may prevent entry of the recording medium between the stripping film 51 and the photoreceptor drum 12 as the recording medium presses the stripping film 51.

EXAMPLES

The present invention is further illustrated by the following examples, although these examples are not intended to limit the present invention.

Example 1

Figure 7:
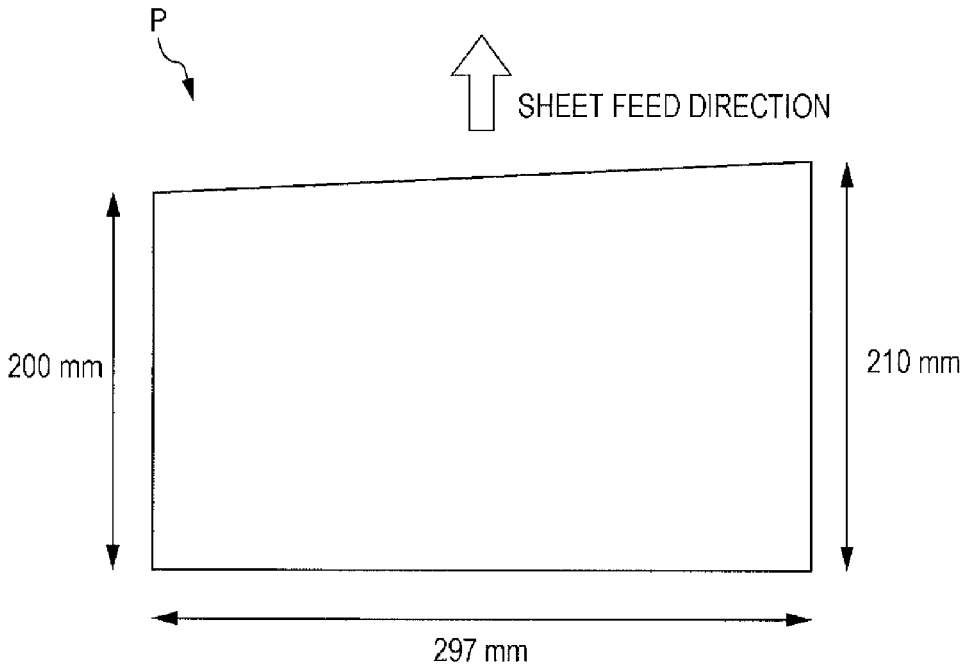
FIG. 7 illustrates the shape of sheets used in examples and comparative examples.

An image-forming apparatus 1 including the devices such as the stripping device 50 shown in FIGS. 4 to 6 is used to form images on recording paper (sheets) and strip the sheets. Each example is evaluated for sheet strippability. The sheets used are A4 Tomazara groundwood paper (49 gsm) available from Oji Paper Co., Ltd. cut into the shape shown in FIG. 7 (which illustrates the shape of the sheets used in the examples and the comparative examples).

The stripping film 51 used is a polyethylene terephthalate (PET) film (Lumirror S10 available from Toray Industries, Inc.) having a width d4 (see FIG. 5) of 10 mm and a thickness of 0.100 mm. The assisting member 52 used is a stainless steel sheet having a thickness of 1 mm. The stripping device 50 of this example is separable (detachable) from the housing 19; it is referred to as "separable".

The length d1 (see FIG. 5) of the stripping film 51, the length d2 (see FIG. 5) of the assisting member 52, and the length d3 (see FIG. 5) of the portion of the stripping film 51 extending beyond the assisting member 52 in each example are as shown in Table 1.

Example 2

Images are formed as in Example 1 except that a PET film having a thickness of 1 mm is used as the assisting member 52, and the sheet strippability is evaluated.

Example 3

Images are formed as in Example 1 except that a housing 19 made of an acrylonitrile-butadiene-styrene (ABS) resin is used as the assisting member 52, and the sheet strippability is evaluated. The stripping device 50 of this example is integrated with the housing 19; it is referred to as "integrated".

Examples 4 to 12

Images are formed as in Example 1 except that the thickness and length d1 of the stripping film 51, the length d2 of the assisting member 52, and the length d3 of the portion of the stripping film 51 extending beyond the assisting member 52 are as shown in Table 1, and the sheet strippability is evaluated.

Comparative Examples 1 and 2

Images are formed on sheets using an image-forming apparatus 1 having the same configuration as in Examples 1 to 12 except that no assisting member 52 is provided. Each comparative example is evaluated for sheet strippability.

It is demonstrated in advance that the PET films, having thicknesses of 0.075 to 0.188 mm, used as the stripping film 51 in Examples 1 to 12 and Comparative Examples 1 and 2 cause little damage to a rotating photoreceptor drum 12 when brought into contact therewith.

Evaluation Results

Sheet Strippability

The strippability of sheets from the photoreceptor drum 12 is evaluated. Specifically, images are formed on 100 sheets, and the number of sheets normally stripped by the stripping device 50 is counted. The sheet strippability is rated on the following scale:

Excellent: 95 or more sheets are normally stripped.

Good: 85 to less than 95 sheets are normally stripped.

Fair: 75 to less than 85 sheets are normally stripped.

Poor: less than 75 sheets are normally stripped.

The evaluation results are shown in Table 1.

As shown in Table 1, Examples 1 to 12 are rated as "good" or "excellent" for sheet strippability, demonstrating that sheets may be smoothly stripped.

In contrast, Comparative Examples 1 and 2 are rated as "poor" for sheet strippability, demonstrating that problems with stripping of paper, such as a jam, are more likely to occur in Comparative Examples 1 and 2 than in Examples 1 to 12.

The above results demonstrate that, whereas problems with stripping of sheets tend to occur in Comparative Examples 1 and 2, in which no assisting member 52 is provided, sheets may be smoothly stripped in Examples 1 to 4, in which an assisting member 52 is provided in the stripping device 50, despite the use of a thin stripping film 51.

That is, the above results demonstrate that a thin stripping film 51 may be used for stripping of sheets in Examples 1 to 12. This may reduce the load on the surface of the photoreceptor drum 12 when stripping is not performed and may thus reduce the damage to the surface of the photoreceptor drum 12.

Example 2 demonstrates that sheets may be smoothly stripped using a PET film as the assisting member 52.

Example 3 demonstrates that sheets may be smoothly stripped using an integrated stripping device 50 in which the housing 19 serves as the assisting member 52.

Comparisons between Examples 1 and 5 and between Examples 4 and 6 demonstrate that sheets may be more smoothly stripped using a PET stripping film 51 having a thickness of 0.100 mm than using a PET stripping film 51 having a thickness of 0.075 mm.

Comparisons between Examples 1 and 9 and between Examples 4 and 10 demonstrate that sheets may be more smoothly stripped using an assisting member 52 having a length d2 of 2.5 mm than using an assisting member 52 having a length d2 of 1.5 mm.

TABLE 1

| | Assisting member | | | Stripping film | | | Evaluation results |
|---|---|---|---|---|---|---|---|
| | Type | Material | Length d2 (mm) | Thickness (mm) | Length d1 (mm) | Length d3 (mm) | Sheet strippability |
| Example 1 | Separable | Stainless steel | 1.5 | 0.075 | 8 | 6.5 | Good |
| Example 2 | Separable | PET | 1.5 | 0.075 | 8 | 6.5 | Good |
| Example 3 | Integrated | ABS | 1.5 | 0.075 | 8 | 6.5 | Good |
| Example 4 | Separable | Stainless steel | 1.5 | 0.075 | 12 | 10.5 | Good |
| Example 5 | Separable | Stainless steel | 1.5 | 0.100 | 8 | 6.5 | Excellent |
| Example 6 | Separable | Stainless steel | 1.5 | 0.100 | 12 | 10.5 | Excellent |
| Example 7 | Separable | Stainless steel | 1.5 | 0.188 | 8 | 6.5 | Excellent |
| Example 8 | Separable | Stainless steel | 1.5 | 0.188 | 12 | 10.5 | Excellent |
| Example 9 | Separable | Stainless steel | 2.5 | 0.075 | 8 | 5.5 | Excellent |
| Example 10 | Separable | Stainless steel | 2.5 | 0.075 | 12 | 9.5 | Excellent |
| Example 11 | Separable | Stainless steel | 2.5 | 0.100 | 8 | 5.5 | Excellent |
| Example 12 | Separable | Stainless steel | 2.5 | 0.100 | 12 | 9.5 | Excellent |
| Comparative Example 1 | | None | | 0.075 | 8 | — | Poor |
| Comparative Example 2 | | None | | 0.075 | 12 | — | Poor |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming unit comprising:

an image carrier that rotates and carries an image;

a substantially sheet-shaped stripping member that has a first surface and a second surface opposite the first surface, that is elastically deformed with part of the first surface in contact with the image carrier, and that strips a recording medium from the image carrier; and a pressing member disposed downstream of the stripping member in a direction in which the image carrier moves, wherein the stripping member is pressed against the pressing member by a recording medium being transported to increase the contact force of the stripping member on the image carrier, wherein the stripping member includes a separated portion that is separated from the pressing member when no recording medium is transported thereto; and part of the separated portion is pressed against the pressing member as the stripping member is pressed by a recording medium.

2. The stripping mechanism according to claim 1, wherein the opposing member is more rigid than the stripping member.

3. The stripping mechanism according to claim 1, wherein the stripping member is narrower in an axial direction of the image carrier toward a leading end of the stripping member that comes into contact with the image carrier.

4. An image-forming apparatus comprising:

an image carrier that rotates and carries an image;

a transfer unit that transfers the image from the image carrier to a recording medium; and a stripping mechanism that strips the recording medium to which the image is transferred by the transfer unit from the image carrier, the stripping mechanism including a substantially sheet-shaped stripping member that has a first surface and a second surface opposite the first surface, that is elastically deformed with part of the first surface in contact with the image carrier, and that strips a recording medium from the image carrier, and an opposing member that is disposed downstream of the stripping member in a direction in which the image carrier moves, that extends toward the image carrier, and that is opposite the first surface of the stripping member, wherein the stripping member includes a separated portion that is separated from the opposing member when no recording medium is transported thereto; and part of the separated portion is pressed against the opposing member as the stripping member is pressed by a recording medium.

5. A stripping mechanism comprising:

a substantially sheet-shaped stripping member that has a first surface and a second surface opposite the first surface, that is elastically deformed with part of the first surface in contact with an image carrier which rotates and carries an image, and that strips a recording medium from the image carrier; and an opposite member that is disposed downstream of the stripping member in a direction in which the image carrier moves, that extends toward the image carrier, and that is opposite the first surface of the stripping member, wherein the stripping member includes a separated portion that is separated from the opposite member when no recording medium is transported thereto; and an area separating a part of the separated portion from the opposite member is decreased as the stripping member is pressed by a recording medium.

* * * * *